US012286747B2

(12) United States Patent
Jung et al.

(10) Patent No.: US 12,286,747 B2
(45) Date of Patent: Apr. 29, 2025

(54) REACTIVE FIBERS, METHOD OF MANUFACTURING THE SAME, AND OUTER SHELL OF CHEMICAL, BIOLOGICAL AND RADIOLOGICAL PROTECTIVE CLOTHING INCLUDING THE SAME

(71) Applicant: Agency for Defense Development, Daejeon (KR)

(72) Inventors: Hyun Sook Jung, Daejeon (KR); Min Kun Kim, Daejeon (KR); Seong On Jang, Daejeon (KR); Jun O Lee, Daejeon (KR); Hee Soo Jung, Daejeon (KR)

(73) Assignee: Agency for Defense Development, Daejeon (KR)

( * ) Notice: Subject to any disclaimer, the term of this patent is extended or adjusted under 35 U.S.C. 154(b) by 508 days.

(21) Appl. No.: 16/862,420

(22) Filed: Apr. 29, 2020

(65) Prior Publication Data

US 2020/0392666 A1 Dec. 17, 2020

(30) Foreign Application Priority Data

Jun. 13, 2019 (KR) ..... 10-2019-0070061

(51) Int. Cl.
*D06M 11/83* (2006.01)
*D06M 11/155* (2006.01)
(Continued)

(52) U.S. Cl.
CPC ..... *D06M 11/83* (2013.01); *D06M 11/155* (2013.01); *D06M 11/20* (2013.01);
(Continued)

(58) Field of Classification Search
CPC ..... D06M 11/36; D06M 11/48; D06M 11/45; D06M 11/46; D06M 11/83; D06M 13/50;
(Continued)

(56) References Cited

U.S. PATENT DOCUMENTS 11,648,548 B1 * 5/2023 Landers ..... B01J 31/1691 502/201
2004/0009726 A1 * 1/2004 Axtell ..... B01J 20/3293 442/123
(Continued)

FOREIGN PATENT DOCUMENTS

CN 116570766 A * 8/2023
KR 10-2019-0070061 4/1720
(Continued)

OTHER PUBLICATIONS

Espacenet translation of KR 20150108158A. (Year: 2015).*
(Continued)

*Primary Examiner* — Jeremy R Pierce
*Assistant Examiner* — Christine X Nisula
(74) *Attorney, Agent, or Firm* — EVAN LAW GROUP LLC

(57) ABSTRACT

A reactive fiber, a method of manufacturing the reactive fiber, and an outer shell of chemical, biological and radiological (CBR) protective clothing including the reactive fiber are provided. The reactive fiber includes a fiber, a plurality of reactive projections formed on a surface of the fiber, and a plurality of hydrophobic projections formed on the fiber and surfaces of the reactive projections.

12 Claims, 2 Drawing Sheets

(51) Int. Cl.

| | |
|---|---|
| ***D06M 11/20*** | (2006.01) |
| ***D06M 15/233*** | (2006.01) |
| ***D06M 15/643*** | (2006.01) |
| ***D06M 23/14*** | (2006.01) |
| *D06M 101/06* | (2006.01) |
| *D06M 101/32* | (2006.01) |
| *D06M 101/34* | (2006.01) |

(52) U.S. Cl.
CPC ..... *D06M 15/233* (2013.01); *D06M 15/643* (2013.01); *D06M 23/14* (2013.01); *D06M 2101/06* (2013.01); *D06M 2101/32* (2013.01); *D06M 2101/34* (2013.01); *D06M 2200/12* (2013.01)

(58) Field of Classification Search
CPC ..... A62D 5/00; B32B 27/12; A62B 17/006; D01F 1/10
See application file for complete search history.

(56) References Cited

U.S. PATENT DOCUMENTS

| | | | | |
|---|---|---|---|---|
| 2010/0081750 | A1* | 4/2010 | Guire | C09D 7/63 524/493 |
| 2010/0113857 | A1* | 5/2010 | Ramakrishna | A61L 2/23 264/441 |
| 2020/0061403 | A1* | 2/2020 | Böhringer | B32B 7/12 |
| 2020/0115395 | A1* | 4/2020 | Baek | B01J 35/1028 |
| 2020/0165461 | A1* | 5/2020 | Brockway | F28F 13/187 |

FOREIGN PATENT DOCUMENTS

| | | | | |
|---|---|---|---|---|
| KR | 20150108158 | | 9/2015 | |
| KR | 20180122819 | | 11/2018 | |
| KR | 20160054086 | A * | 5/2019 | |
| WO | WO-2006081512 | A2 * | 8/2006 | B82Y 30/00 |

OTHER PUBLICATIONS

Espacenet translation of KR 201801122819A. (Year: 2018).*
Espacenet translation of KR20160054086A. (Year: 2016).*
Espacenet translation of CN116570766A (Year: 2023).*

* cited by examiner

Reactive projection@Fiber

Hydrophobic material@Fiber

Reactive projection/Hydrophobic material@Fiber

REACTIVE FIBERS, METHOD OF MANUFACTURING THE SAME, AND OUTER SHELL OF CHEMICAL, BIOLOGICAL AND RADIOLOGICAL PROTECTIVE CLOTHING INCLUDING THE SAME

CROSS-REFERENCE TO RELATED APPLICATION(S)

This application claims the priority benefit of Korean Patent Application No. 10-2019-0070061, filed on Jun. 13, 2019, in the Korean Intellectual Property Office, the disclosure of which is incorporated herein by reference for all purposes.

BACKGROUND

1. Field

One or more example embodiments relate to reactive fibers, a method of manufacturing the same, and chemical, biological and radiological (CBR) protective clothing including the same.

2. Description of Related Art

Currently, an outer shell of chemical, biological and radiological (CBR) protective clothing is coated with a fluorocarbon-type material, in particular, polytetrafluoroethylene (PTFE) or Teflon, and exhibits water- and oil-repellent properties. However, Teflon is an expensive chemical material and its use is restricted in developed countries such as the United States due to release of perfluorooctanoic acid (PFOA) that is an environmentally hazardous substance with toxicity remaining in a human body. Also, CBR protective clothing with a surface treated with a fluorocarbon-type material has weak durability due to abrasion, such as a significant decrease in water and oil repellency after washing.

Accordingly, in developed countries such as the U.S. Army Natick Soldier Research, Development and Engineering Center (NSRDEC) in the United States, technologies of coating a fiber surface with C-4- and C-6-based fluorocarbon chemical materials containing a low amount of fluorine are being researched and developed. Also, technologies of coating fibers with a non-fluorocarbon-based compound with water-repellent properties in a form of a nanostructure are being developed, and research is being conducted on fibers capable of achieving an excellent protection performance against water, oil and chemical warfare agents while maintaining fiber functions.

SUMMARY

One or more example embodiments are to solve the above-mentioned problems, and an aspect provides a reactive fiber having an excellent protection performance against water, oil and a chemical agent, and a method of manufacturing the reactive fiber.

Also, another aspect provides an outer shell of chemical, biological and radiological (CBR) protective clothing to which the reactive fiber is applied, and CBR protective clothing including the reactive fiber.

However, problems to be solved by the present disclosure are not limited to the above-described problems, and other problems not mentioned herein can be clearly understood by those skilled in the art from the following descriptions.

According to an example embodiment, there is provided a reactive fiber including a fiber, a plurality of reactive projections formed on a surface of the fiber, and a plurality of hydrophobic projections formed on the fiber and surfaces of the reactive projections.

Each of the reactive projections may have a diameter of 100 nanometers (nm) to 100 micrometers (μm).

A distance between the reactive projections may be in a range of 10 nm to 10 μm.

Each of the hydrophobic projections may have a diameter of 5 nm to 10 μm.

The fiber may include at least one selected from the group consisting of cotton, polyester, polyethylene terephthalate and rayon.

The reactive projections may have decomposition reactivity of at least one selected from the group consisting of a nerve agent, a blister agent, an industrial toxic substance and a toxic gas.

Each of the reactive projections may include at least one selected from the group consisting of a metal oxide, a metal hydroxide and a metal-organic complex.

Each of the reactive projections may include at least one selected from the group consisting of $Zr(OH)_4$, ZrO, MOF-808, UiO-66-$NH_2$, $TiO_2$ and $Mg(OH)_2$.

Each of the hydrophobic projections may include an organic compound, an inorganic compound or an organic/inorganic composite compound which has a hydrophobicity.

Each of the hydrophobic projections may include at least one selected from the group consisting of polystyrene (PS), polyhedral oligomeric silsesquioxane (POSS), a compound including Si or Al particles to which a hydrocarbon or alkyl group is attached, Zr and Mg.

According to an example embodiment, there is provided a method of manufacturing a reactive fiber, the method including rendering a surface of a fiber to be hydrophilic by treating the fiber with a basic solution, forming a reactive projection on the surface of the fiber by dipping the fiber treated with the basic solution into a solution containing a precursor of a reactive particle, and coating the surface of the fiber on which the reactive projection is formed with a hydrophobic material, and treating the fiber with a hydrophilic solvent.

The rendering of the surface of the fiber to be hydrophilic may be performed for a period of 0.5 hours to 4 hours.

The basic solution may include at least one selected from the group consisting of KOH, NaOH and $Mg(OH)_2$.

The forming of the reactive projection on the surface of the fiber may be performed for a period of 0.5 hours to 24 hours.

The precursor of the reactive particle may include at least one selected from the group consisting of zirconium oxychloride, titanium chloride and magnesium chloride.

The hydrophobic material may include at least one selected from the group consisting of PS, POSS, a compound including Si or Al particles to which a hydrocarbon or alkyl group is attached, and Si or Al particles to which fluorocarbon (C6 or less) is attached.

The hydrophilic solvent may include at least one selected from the group consisting of water and ethanol.

According to an example embodiment, there is provided an outer shell of CBR protective clothing. The outer shell may be woven from the above reactive fiber or a reactive fiber manufactured by the method.

According to an example embodiment, there is provided CBR protective clothing including the outer shell.

According to example embodiments, reactive projections and hydrophobic projections with micro/nano composite structures may be formed on surfaces of fibers, and thus it is possible to maintain functions of fibers and to realize functional fibers with excellent protection performances against water, oil and a chemical agent.

Thus, non-toxic, low-cost and lightweight materials may be used, thereby securing an effect equal to or greater than that of the existing fluorocarbon-based coating treatment with a minimum cost. Also, the above materials may be used for various purposes, for example, for protective clothing for private industries as well as CBR protective equipment.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION OF EXEMPLARY EMBODIMENTS

Figure 1:
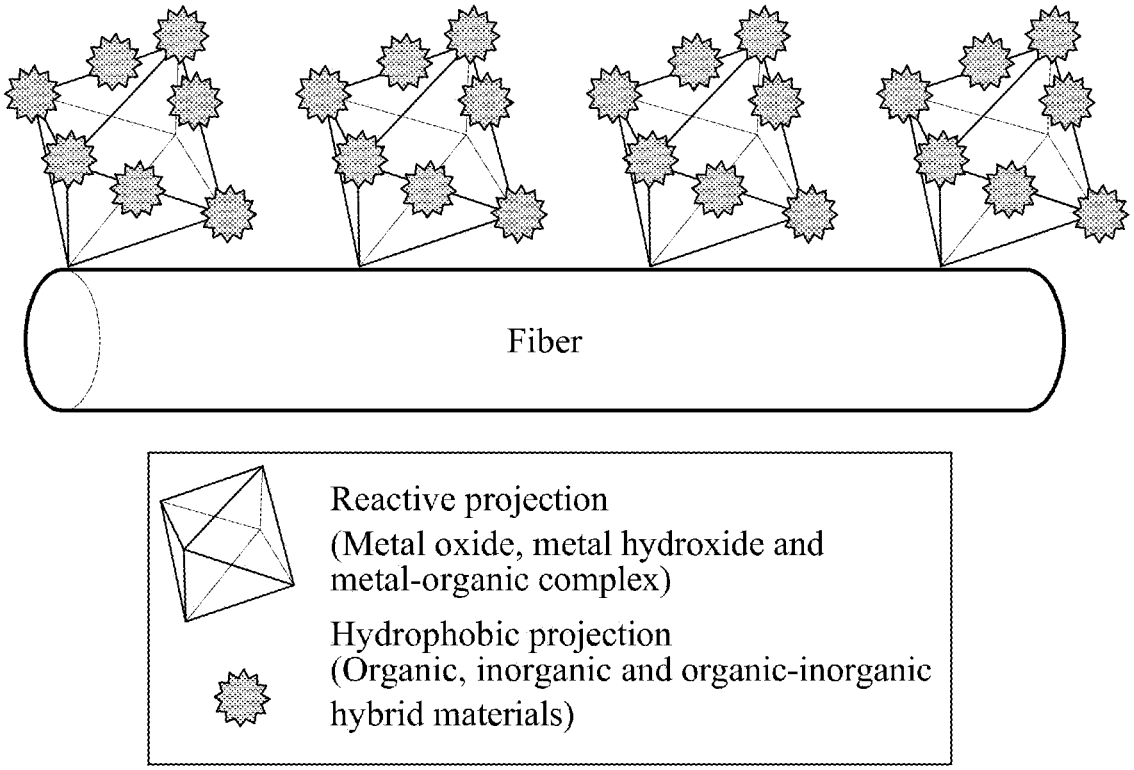
FIG. 1 is a diagram illustrating a reactive fiber according to an example embodiment.

Hereinafter, example embodiments will be described in detail with reference to the accompanying drawings. When it is determined detailed description related to a related known function or configuration they may make the purpose of the present disclosure unnecessarily ambiguous in describing the present disclosure, the detailed description will be omitted here. Also, terminologies used herein are defined to appropriately describe the example embodiments of the present disclosure and thus may be changed depending on a user, the intent of an operator, or a custom of a field to which the present disclosure pertains. Accordingly, the terminologies must be defined based on the following overall description of the present specification. The same reference numerals as shown in each drawing represent same elements.

Throughout the specification, when any element is positioned "on" the other element, this not only includes a case that the any element is brought into contact with the other element, but also includes a case that another element exists between two elements.

Throughout the specification, if a prescribed part "includes" a prescribed element, this means that another element can be further included instead of excluding other elements unless any particularly opposite description exists.

Hereinafter, a reactive fiber, a method of preparing the reactive fiber, and an outer shell of chemical, biological and radiological (CBR) protective clothing including the reactive fiber will be described in detail with reference to example embodiments and drawings. However, the present disclosure is not limited to the example embodiments and drawings.

FIG. 1 is a diagram illustrating a reactive fiber according to an example embodiment. Hereinafter, the present disclosure is described with reference to FIG. 1.

The reactive fiber may include a fiber, a plurality of reactive projections formed on a surface of the fiber, and a plurality of hydrophobic projections formed on the fiber and surfaces of the reactive projections.

The reactive fiber may include a reactive projection including particles reactive to toxic CBR materials, and a hydrophobic projection including organic, inorganic and organic-inorganic hybrid materials that exhibit hydrophobicity, thereby realizing a reactive fiber with an enhanced protection performance against water and oil while maintaining a protection performance against a chemical agent.

The reactive projection may have a diameter of 100 nanometers (nm) to 100 micrometers (μm). When the diameter of the reactive projection exceeds 100 μm, a reactivity may decrease. When the diameter of the reactive projection is less than 100 nm, reactive particles may clump together.

A distance, that is, a pitch between the plurality of reactive projections may be in a range of 10 nm to 10 μm. When the distance exceeds 10 μm, reactivity may decrease. When the distance is less than 10 nm, an insufficient surface structure effect may appear due to a gap between projections.

The hydrophobic projection may have a diameter of 5 nm to 10 μm. When the diameter of the hydrophobic projection exceeds 10 μm, a reaction effect of the reactive projection may be lowered. When the diameter of the hydrophobic projection is less than 5 nm, a surface treatment effect by the hydrophobic projection may be insufficient.

The fiber may include at least one selected from a group consisting of cotton, polyester, polyethylene terephthalate and rayon. Desirably, the fiber may be a cotton fiber or a cotton blend that occupies a large portion of an outer shell of CBR protective clothing.

The reactive projection may have decomposition reactivity of at least one selected from the group consisting of a neuro agent, a blister agent, an industrial toxic substance and a toxic gas. The reactive fiber may have an excellent protection performance against a chemical agent, and may decompose at least one selected from the group consisting of an industrial toxic substance and a toxic gas.

The reactive projection may include at least one selected from the group consisting of a metal oxide, a metal hydroxide and a metal-organic complex. Micro/nano reactive projections including reactive particles may be, in particular, zirconium-based oxide, hydroxide or metal-organic complex. The reactive fiber may include the reactive projections, thereby implementing a protection performance against a liquid chemical agent.

The reactive projection may include at least one selected from the group consisting of $Zr(OH)_4$, ZrO, MOF-808, UiO-66-$NH_2$, $TiO_2$ and $Mg(OH)_2$.

The hydrophobic projection may include an organic compound, an inorganic compound or an organic/inorganic composite compound which has hydrophobicity. A hydrophobic projection with hydrophobic properties may enhance wettability of a fiber surface to water and oil, and may increase a protection performance of the outer shell of CBR protective clothing against water, oil and a toxic chemical agent through a synergistic effect of composite projections with micro/nano structures.

The hydrophobic projection may include at least one selected from the group consisting of polystyrene (PS), polyhedral oligomeric silsesquioxane (POSS), a compound including Si or Al particles to which a hydrocarbon or alkyl group is attached, and Si or Al particles to which fluorocarbon (C6 or less) is attached. A material with hydrophobic properties may typically include, for example, a PS-based compound, POSS, or Si or Al particles to which a hydrocarbon or alkyl group is attached.

According to an example embodiment, a method of manufacturing a reactive fiber includes rendering a surface of a fiber to be hydrophilic by treating the fiber with a basic solution, forming a reactive projection on the surface of the fiber by dipping the fiber treated with the basic solution into a solution containing a precursor of a reactive particle, and coating the surface of the fiber on which the reactive projection is formed with a hydrophobic material, and treating the fiber with a hydrophilic solvent.

Particles reactive to toxic chemical materials may be grown to be micro/nano-scale reactive projection, and a surface of the reactive projection may be coated with organic, inorganic and organic-inorganic hybrid materials having hydrophobicity, to manufacture a reactive fiber with an enhanced protective performance against water and oil while maintaining a protective performance against a chemical agent.

The rendering of the surface of the fiber to be hydrophilic may be performed for a period of 0.5 hours to 4 hours.

The basic solution may include at least one selected from the group consisting of NaOH, KOH and $Mg(OH)_2$.

The surface of the fiber may be rendered to be a hydrophilic surface by treating the fiber with the basic solution for a predetermined period of time. Desirably, a cotton fiber may be treated with a KOH solution for a period of 0.5 hours to 4 hours to render a surface of the cotton fiber to be hydrophilic.

The forming of the reactive projection on the surface of the fiber may be performed for a period of 0.5 hours to 24 hours.

The precursor of the reactive particle may include at least one selected from the group consisting of zirconium oxychloride, titanium chloride and magnesium chloride.

When the fiber treated through a step of rendering the surface of the fiber to be hydrophilic is dipped into the solution containing the precursor of the reactive particle, a projection may be formed over time. Zirconium oxychloride and 2-amino-terphtalic acid may desirably be used as the precursor. Next, a step of removing impurities through cleaning, and performing vacuum drying may be performed. Desirably, the above process may be repeatedly performed two or three times.

The hydrophobic material may include at least one selected from the group consisting of PS, POSS, a compound including Si or Al particles to which a hydrocarbon or alkyl group is attached, and Si or Al particles to which fluorocarbon (C6 or less) is attached. The hydrophilic solvent may include at least one selected from the group consisting of water and ethanol.

When a surface of a cotton fiber on which a reactive projection is formed through the process is dip-coated with a hydrophobic material (for example, PS or POSS) and is treated again with a hydrophilic solvent, a hydrophobic projection may be formed on a surface of a reactive complex projection.

According to an example embodiment, an outer shell of CBR protective clothing may be woven from the above-described reactive fiber or a reactive fiber that is manufactured by the above-described method.

According to an example embodiment, CBR protective clothing may include the outer shell of the CBR protective clothing.

Hereinafter, the present disclosure will be described in more detail with reference to an example and a comparative example.

However, the following example is given for the purpose of illustrating the present disclosure, and the present disclosure is not limited to the following example.

As the example, a zirconium-based metal-organic complex was grown in a form of a micro/nano projection on a surface of a cotton fiber (100% cotton, high density 60 s), and a surface of a zirconium-based complex projection was treated with hydrophobic POSS materials to have hydrophobicity. Water drops were dropped based on fiber surface properties, to measure each contact angle property.

Figure 2:
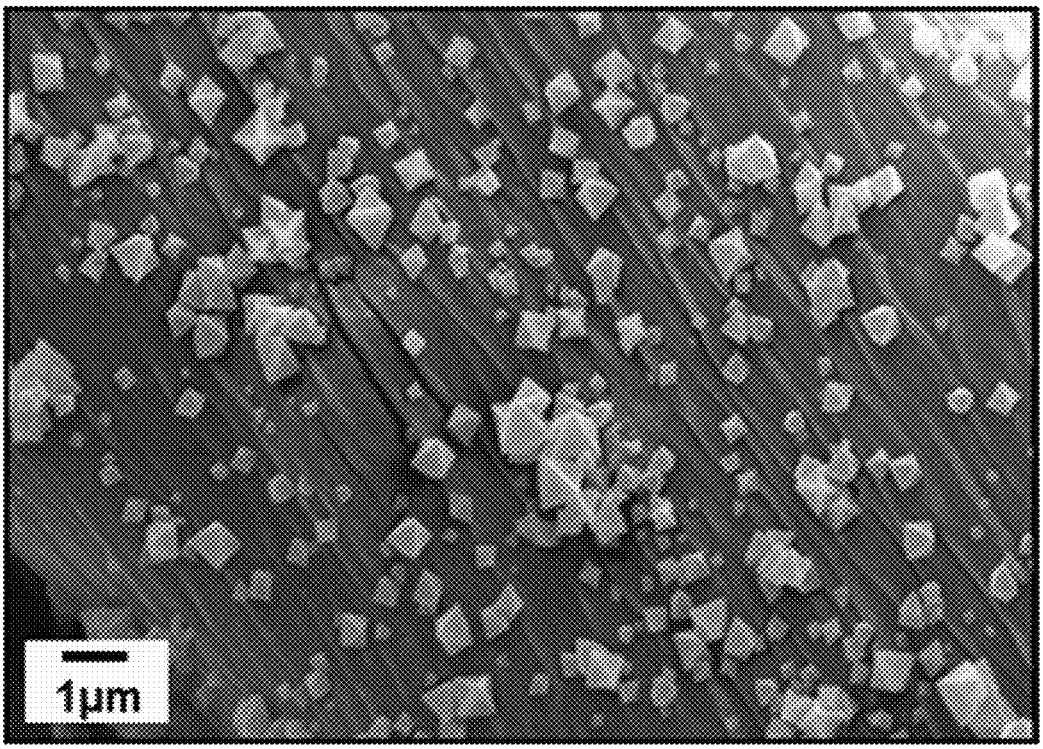
FIG. 2 is a scanning electron microscope (SEM) image of a surface of a reactive fiber manufactured according to an example embodiment.

FIG. 2 is a scanning electron microscope (SEM) image of a surface of a reactive fiber manufactured according to an example embodiment.

Referring to FIG. 2, it may be found that reactive projections and hydrophobic projections are formed on surfaces of fibers.

Figure 3:
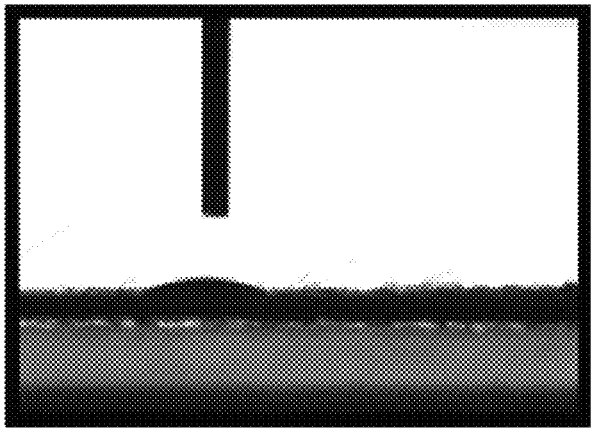
FIG. 3 illustrates images obtained by measuring contact angle properties of a reactive fiber manufactured according to an example embodiment.
Figure 3:
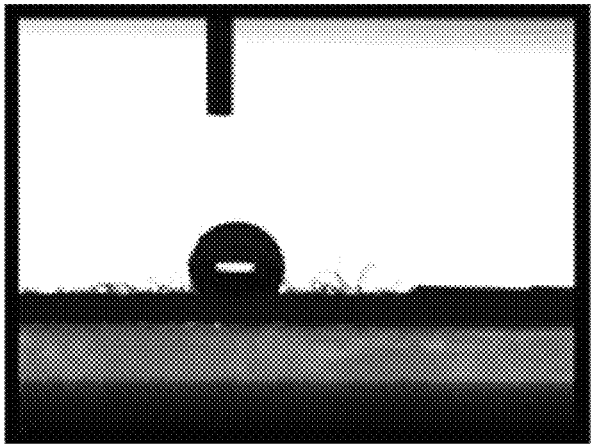
Figure 3:
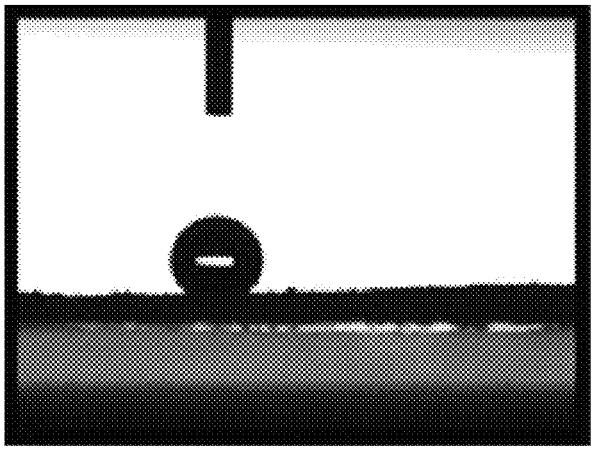

FIG. 3 illustrates images obtained by measuring contact angle properties of a reactive fiber manufactured according to an example embodiment.

Referring to FIG. 3, it may be found that wettability of a surface of a fiber on which only a reactive projection is formed is not improved, and that wettability of a surface of a fiber on which a reactive projection and a hydrophobic projection are formed concurrently is enhanced while implementing a protection performance against a chemical agent.

According to example embodiments, a reactive fiber includes a reactive projection to implement a protection performance against a liquid chemical agent, and a hydrophobic projection with hydrophobic properties may enhance wettability of a surface of a fiber against water and oil, and accordingly it is possible to increase a protection performance of an outer shell of CBR protective clothing against water, oil and a toxic chemical agent through a synergistic effect of composite projections with micro/nano structures. Thus, non-toxic, low-cost and lightweight materials may be used, thereby securing an effect equal to or greater than that of the existing fluorocarbon-based coating treatment with a minimum cost. Also, the above materials may be used for various purposes, for example, for protective clothing for private industries as well as CBR protective equipment.

While a few example embodiments have been shown and described with reference to the accompanying drawings, it will be apparent to those skilled in the art that various modifications and variations can be made from the foregoing descriptions. For example, adequate effects may be achieved even if the foregoing processes and methods are carried out in different order than described above, and/or the aforementioned elements are combined or coupled in different forms and modes than as described above or be substituted or switched with other components or equivalents. Thus, other implementations, alternative embodiments and equivalents to the claimed subject matter are construed as being within the appended claims.

What is claimed is:

1. A reactive fiber comprising:

a fiber;

a plurality of reactive projections formed on a surface of the fiber; and a plurality of hydrophobic projections formed on the fiber and surfaces of the reactive projections, wherein each of the hydrophobic projections has a diameter of 5 nm to 10 μm, wherein the hydrophobic projections are hydrophobic, and wherein each of the hydrophobic projections comprises a compound including Al particles to which a hydrocarbon or alkyl group is attached.

2. The reactive fiber of claim 1, wherein each of the reactive projections has a diameter of 100 nanometers (nm) to 100 micrometers (μm).

3. The reactive fiber of claim 1, wherein a distance between the reactive projections is in a range of 10 nm to 10 μm.

4. The reactive fiber of claim 1, wherein the fiber comprises at least one selected from the group consisting of cotton, polyester, polyethylene terephthalate and rayon.

5. The reactive fiber of claim 1, wherein the reactive projections have decomposition reactivity of at least one selected from the group consisting of a nerve agent, a blister agent, an industrial toxic substance and a toxic gas.

6. The reactive fiber of claim 1, wherein each of the reactive projections comprises at least one selected from the group consisting of a metal oxide, a metal hydroxide and a metal-organic complex.

7. The reactive fiber of claim 1, wherein each of the reactive projections comprises at least one selected from the group consisting of $Zr(OH)_4$, ZrO, MOF-808, UiO-66-$NH_2$, $TiO_2$ and $Mg(OH)_2$.

8. The reactive fiber of claim 2, wherein a distance between the reactive projections is in a range of 10 nm to 10 μm.

9. The reactive fiber of claim 1, wherein each of the hydrophobic projections comprises a compound including Al particles to which a hydrocarbon group is attached.

10. The reactive fiber of claim 1, wherein each of the hydrophobic projections comprises a compound including Al particles to which an alkyl group is attached.

11. An outer shell of chemical, biological and radiological (CBR) protective clothing, the outer shell being woven from the reactive fiber of claim 1.

12. Chemical, biological and radiological (CBR) protective clothing comprising the outer shell of claim 11.

* * * * *